US005515800A

United States Patent [19]

Thompson

[11] Patent Number: 5,515,800

[45] Date of Patent: May 14, 1996

[54] METHOD FOR MAKING WEARING APPAREL FROM ENVELOPE PORTIONS

[76] Inventor: Thomas M. Thompson, 1 Dream Manor Dr. P.O. 2510, Globe, Ariz. 85502

[21] Appl. No.: 258,324

[22] Filed: Jun. 10, 1994

[51] Int. Cl.[6] ..... D05B 25/00; A41H 43/02

[52] U.S. Cl. ..... 112/475.09; 2/69; 2/243.1; 2/102

[58] Field of Search ..... 112/440, 441, 112/262.1; 83/911, 912; 2/69, 72, 213, 89, 69.5, 243.1, 108, 102, 239; 229/68.1; 493/384, 938; 224/148; 383/4

[56] References Cited

U.S. PATENT DOCUMENTS

| | | | |
|---|---|---|---|
| 2,521,017 | 9/1950 | Moen et al. | 2/200.3 X |
| 3,229,875 | 1/1966 | Stoller | 2/239 X |
| 3,577,305 | 5/1971 | Hines et al. | 2/243.1 X |
| 3,727,236 | 4/1973 | Lloyd et al. | 2/51 |
| 4,649,573 | 3/1987 | Yen | 2/108 X |
| 4,926,729 | 5/1990 | Igarashi | 83/912 X |
| 5,247,709 | 9/1993 | Epply | 2/200,3 X |

FOREIGN PATENT DOCUMENTS

| | | | |
|---|---|---|---|
| 4119340 | 10/1991 | Germany | 2/243.1 |
| 2209323 | 5/1989 | United Kingdom | 2/243.1 |

OTHER PUBLICATIONS

Golf Day, "Tyvek Jacket", 1992.

DuPont Technical Information, Tyvek Spunbonded Olefin, 1970.

*Primary Examiner*—Ismael Iaguirre

*Attorney, Agent, or Firm*—Harry M. Weiss; Jeffrey D. Moy; Harry M. Weiss & Associates

[57] ABSTRACT

A method of making lightweight, tear-resistant, and water-resistant wearing apparel comprises the steps of removing unwanted portions from used envelopes, connecting a plurality of the envelopes together into a sheet, cutting the sheet into apparel portions, and coupling the apparel portions together in order to form the wearing apparel. The used envelopes are made from a lightweight, substantially tear-resistant, and substantially water-resistant material such as TYVEK. This method also provides a desirable method for recycling used envelopes into useful wearing apparel.

13 Claims, 1 Drawing Sheet

METHOD FOR MAKING WEARING APPAREL FROM ENVELOPE PORTIONS

BACKGROUND OF THE INVENTION

1. Field of the Invention

This invention relates generally to methods for making wearing apparel and, more specifically, to a method for recycling used envelopes in order to make wearing apparel therefrom.

2. Description of the Related Art

In the past, those in the package delivery industry sought after a lightweight, tear-resistant, and water-resistant material for minimizing the weight of a package enclosed by such a material and for protecting the contents therein throughout the delivery process. A material having such aforementioned properties was developed by the Dupont corporation under the trademark name, TYVEK. Currently, the United States Postal Service, Federal Express, and other package delivery organizations use this TYVEK material to make several different types of envelopes. The use of envelopes made out of TYVEK is widespread. Thus, due to the widespread use of such extremely durable envelopes, there exists the problem of disposing of these TYVEK envelopes.

Unfortunately, many of these envelopes, after being used, are simply disposed of within municipal landfills. It would be far more desirable to transform these used envelopes into useful products as opposed to having these used envelopes consume a large part of a limited landfill area.

With this desire in mind, there is a need in the wearing apparel industry for lightweight, durable clothing. Certainly, there are many different types of clothing and production methods therefore, however, until now, no one has taken advantage of the lightweight, tear-resistant, and water resistant properties of TYVEK envelope material from used TYVEK envelopes in order to produce lightweight, durable wearing apparel.

Therefore, there existed a need to provide a method of recycling used TYVEK envelopes in order to produce lightweight, tear-resistant, and water-resistant wearing apparel.

SUMMARY OF THE INVENTION

In accordance with one embodiment of this invention, it is an object of this invention to provide a method for producing lightweight, durable wearing apparel.

It is another object of this invention to provide a method for producing lightweight, tear-resistant, and water-resistant wearing apparel.

It is still another object of this invention to provide lightweight, tear-resistant, water-resistant, and decorative wearing apparel.

It is a further object of this invention to provide a method for recycling used envelopes.

It is a another object of this invention to provide a method for creating wearing apparel from envelopes.

BRIEF DESCRIPTION OF THE PREFERRED EMBODIMENTS

In accordance with one embodiment of this invention, a method of making wearing apparel is disclosed comprising the steps of removing portions from envelope means, connecting a plurality of the envelope means together into a sheet, cutting the sheet into apparel portions, and coupling the apparel portions together in order to form the wearing apparel. The envelope means comprises an envelope, and the envelope is, preferably, a used envelope fabricated from TYVEK. The step of removing comprises the steps of removing a first seal portion of the envelope means, removing a second seal portion located opposite the first seal portion, and cutting along a third seal portion running from the first seal portion to the second seal portion. The plurality of envelope means are connected together along edge portions thereof, and such connecting is, preferably, accomplished by stitching the edge portions together. The wearing apparel is one of a jacket and a vest, yet, if desired, any type of wearing apparel may be produced via this method.

In accordance with another embodiment of this invention, a method of recycling is disclosed comprising the steps of coupling a plurality of used envelope means into a sheet, and assembling wearing apparel from the sheet. The used envelope means comprises a used envelope made from a lightweight, substantially tear-resistant, and substantially water-resistant material such as TYVEK.

In accordance with yet another embodiment of this invention, a method of making tear-resistant wearing apparel is disclosed comprising the steps of removing portions from tear-resistant envelope means, connecting a plurality of the tear-resistant envelope means together into a sheet, cutting the sheet into apparel portions, and coupling the apparel portions together in order to form the tear-resistant wearing apparel.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENTS

Figure 1:
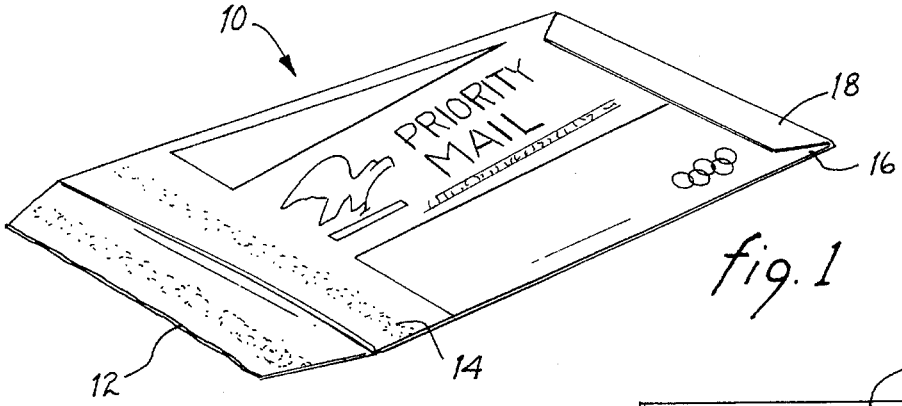
FIG. 1 is a perspective view of a used envelope.

Referring to FIG. 1, a perspective view of a used envelope is shown and is generally designated by reference number 10. Note that this view shows the used envelope 10 or, more simply, the envelope 10, with the top side facing up. Thus, the bottom side of the envelope 10, which is facing downward, is not seen in this view. Additionally note that the envelope 10 is made from a lightweight, substantially tear-resistant, and substantially water-resistant material such as TYVEK.

The TYVEK material is widely used to make such envelopes 10 for organizations within the package delivery field such as the United States Postal Service. TYVEK is a 100% high density polyethylene developed as a spunbonded olefin by the Dupont Corporation. Generally, this material is well known in the materials art as a lightweight, tear-resistant, and water-resistant material.

Again referring to FIG. 1, an upper flap 12 of the envelope 10 is shown open. When a seal strip (not shown) is removed from the upper flap 12 in order to uncover an adhesive material thereunder, the upper flap 12 may be folded down to make contact with surface 14 in order to form an upper seal of the envelope 10. A lower flap 18 is sealed against a surface 16 with an adhesive in order to form a lower seal. An unused envelope has the upper seal open so that a user may place contents therein, and, after the contents are inserted into the envelope, the upper seal is closed. Normally, the lower seal is closed in an unused envelope. On the bottom side of an unused envelope, along the lengthwise dimension thereof, a closed seal extends from the upper seal to the lower seal. Like the lower seal, the bottom side seal is also closed in an unused envelope. In other words, in an unused envelope, only the upper seal is initially open.

Figure 2:
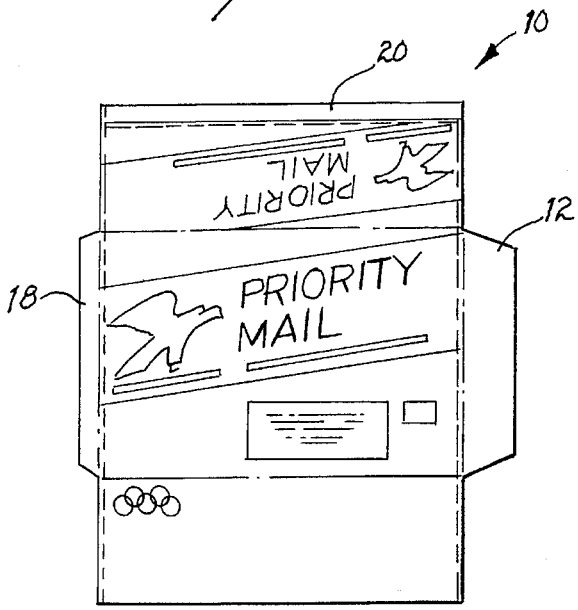
FIG. 2 is a plan view of the envelope of FIG. 1 showing open upper and lower flaps thereof and showing a cut in the envelope along a seal portion extending from the open upper flap to the open lower flap.

Referring to FIG. 2, the used envelope 10 is shown fully open and laid flat. Note that a rectangular box is shown, in phantom. The portion of the used envelope 10 within this rectangular box represents that portion of the envelope 10 that is used to create the sheet 22 from FIG. 3. This portion or usable portion from within the rectangular box is obtained by removing undesired portions from the envelope 10. In particular, one removes the upper seal portion of the envelope 10 in some manner such as cutting. It should be pointed out that in removing this upper seal portion, care must be exercised so as to ensure that the sticky, adhesive portion of the upper seal portion is removed, thereby leaving a non-sticky surface within the phantom rectangular box boundary. In a similar manner, the lower seal portion is removed. At this point, with the upper and lower seal portions removed, the envelope 10 can be stood on end in a manner which resembles a tubular structure. Proceeding, one simply cuts along the bottom strip that extends from where the upper seal portion used to be to where the lower seal portion used to exist. Also, note that any sticky or dirty adhesive portion from the bottom seal portion 20 may be cut out, if desired. Thus, all that remains of the original used envelope 10, within the phantom box boundary, is a rectangular, non-sticky, unfolded envelope 10.

Figure 4:
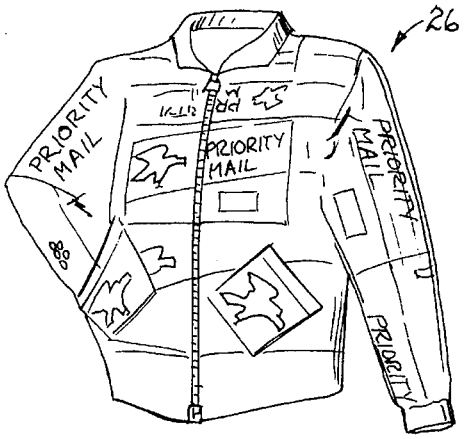
FIG. 4 is a perspective view of one type of lightweight, durable wearing apparel that is produced from the material in the sheet from FIG. 3.
Figure 3:
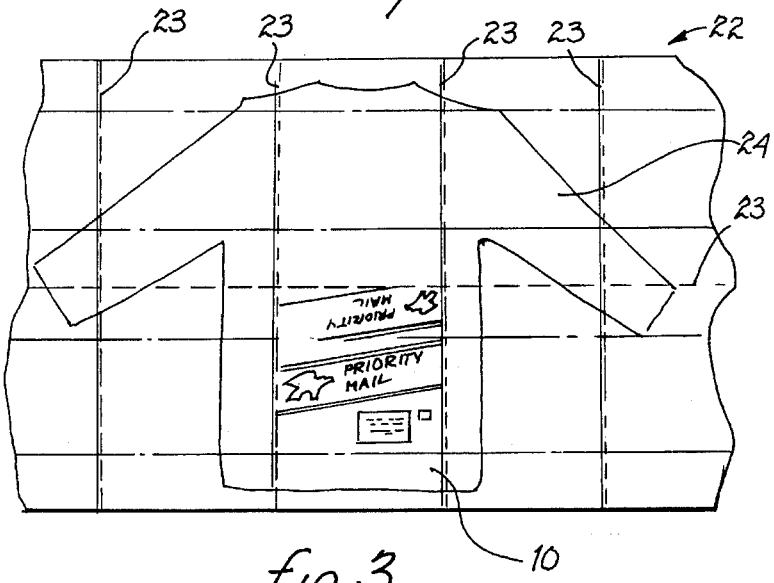
FIG. 3 is a sheet comprised of a plurality of used envelopes connected together.
Figure 5:
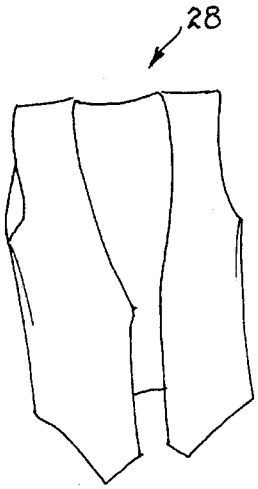
FIG. 5 is a perspective view of another type of lightweight, durable wearing apparel that is produced from the material in the sheet from FIG. 3.

Referring to FIG. 3, a sheet 22 is shown comprised of a plurality of used envelopes 10 that each have portions removed as previously described. Each used envelope 10 of the plurality of used envelopes 10 is connected to an adjacent used envelope 10 along an edge thereof, thereby forming the sheet 22 of used envelopes 10. Note that stitching 23 is the preferred method of connecting the plurality of used envelopes 10, however, other connecting methods may be implemented, if desired. An outline of an apparel portion or wearing apparel portion 24 is shown on the sheet 22. The wearing apparel portion 24 along with other wearing apparel portions (not shown) are cut from the sheet 22, and these wearing apparel portions are subsequently coupled together to form wearing apparel. The various shapes of the wearing apparel portions that are needed to form specific wearing apparel are well known in the clothing manufacturing art. Additionally, clothing manufacturing processes, such as stitching wearing apparel portions together, adding zippers, adding liners, and adding other items to wearing apparel are well known in the art. Thus, using well known clothes manufacturing techniques, one can implement this new method for producing lightweight, tear-resistant, and water-resistant wearing apparel such as the jacket 26 and vest 28 of FIGS. 4 and 5, respectively. It is important to note, any type of wearing apparel may be made with this method.

OPERATION

Referring to FIG. 2, the usable portion of the envelope 10 located within the phantom rectangular box is obtained by removing undesired portions from the envelope 10, as previously described. Referring to FIG. 3, each used envelope 10 of the plurality of used envelopes 10 is connected to an adjacent used envelope 10 along an edge thereof, thereby forming the sheet 22 of used envelopes 10. Stitching 23 is the preferred method of connecting the plurality of used envelopes 10, but other connecting methods may be implemented. The wearing apparel portion 24 and other wearing apparel portions (not shown) are cut from the sheet 22, and these wearing apparel portions are subsequently coupled together to form wearing apparel. Additionally, using well known clothes manufacturing principles, one can implement this new method for producing lightweight, tear-resistant, and water-resistant wearing apparel such as the jacket 26 and the vest 28 of FIGS. 4 and 5, respectively.

While the invention has been particularly shown and described with reference to the preferred embodiments thereof, it will be understood by those skilled in the art that the foregoing and other changes in form and details may be made therein without departing from the spirit and scope of the invention. For example, although the utilization of used envelopes is preferable with respect to recycling used envelopes, one could use new envelopes with the aforementioned methods, if desired.

What is claimed is:

1. A method of making wearing apparel comprising the steps of:

removing adhesive portions from envelope means;

connecting a plurality of said envelope means together into a sheet;

cutting said sheet into apparel portions; and coupling said apparel portions together in order to form said wearing apparel.

2. The method of claim 1 wherein said envelope means comprises an envelope.

3. The method of claim 2 wherein said envelope is a used envelope.

4. The method of claim 3 wherein said envelope is fabricated from a lightweight, substantially tear-resistant, and water-resistant material.

5. The method of claim 1 wherein said step of removing comprises the steps of:

removing a first seal portion of said envelope means;

removing a second seal portion located opposite said first seal portion; and cutting along a third seal portion running from said first seal portion to said second seal portion.

6. The method of claim 1 wherein said plurality of said envelope means are connected together along edge portions thereof.

7. The method of claim 6 wherein said step of connecting is accomplished by stitching said edge portions together.

8. The method of claim 1 wherein said wearing apparel is one of a jacket and a vest.

9. A method of making wearing apparel comprising the steps of:

removing a first seal portion from envelope means;

removing a second seal portion located opposite said first seal portion;

cutting along a third seal portion running from said first seal portion to said second seal portion;

stitching a plurality of said envelope means together along edge portions thereof in order to form a sheet;

cutting said sheet into apparel portions; and coupling said apparel portions together in order to form said wearing apparel.

10. The method of claim 9 wherein said envelope means comprises an envelope.

11. The method of claim 10 wherein said envelope is a used envelope.

12. The method of claim 11 herein said envelope is fabricated from a lightweight, substantially tear-resistant, and water-resistant material.

13. A method of making tear-resistant wearing apparel comprising the steps of:

removing portions from tear-resistant envelope means;

connecting a plurality of said tear-resistant envelope means together into a sheet;

cutting said sheet into apparel portions; and coupling said apparel portions together in order to form said tear-resistant wearing apparel.

* * * * *